United States Patent [19]

Miles

[11] 3,964,277

[45] June 22, 1976

[54] WEFT KNIT FABRIC WITH DEFLECTED INLAID YARN

[76] Inventor: Thomas E. Miles, Box 1307, Lincolnton, N.C. 28092

[22] Filed: July 3, 1974

[21] Appl. No.: 485,524

[52] U.S. Cl. ..... 66/190; 66/197

[51] Int. Cl.[2] ..... D04B 7/14

[58] Field of Search ..... 66/196, 197, 190, 200

[56] References Cited

UNITED STATES PATENTS

| | | | |
|---|---|---|---|
| 1,976,885 | 10/1934 | Levin | 66/200 X |
| 2,105,301 | 1/1938 | Saftlas | 66/190 |
| 2,149,071 | 2/1939 | Reynolds et al. | 66/197 |

FOREIGN PATENTS OR APPLICATIONS

| | | | |
|---|---|---|---|
| 283,182 | 1/1967 | Australia | 66/200 |

*Primary Examiner*—Louis K. Rimrodt
*Assistant Examiner*—Andrew M. Falik
*Attorney, Agent, or Firm*—Bell, Seltzer, Park & Gibson

[57] ABSTRACT

The inlaid yarn is incorporated in a rib or double knit fabric by forming groups of held stitch loops on the face side of the fabric. The inlaid yarns extend behind the held stitch loops and are maintained in position by the rearwardly facing stitch loops on the reverse side of the fabric. The groups of held stitch loops are staggered coursewise so that the inlaid yarns are deflected and extend diagonally between the groups of held stitch loops to provide unique surface patterns on the face side of the fabric.

7 Claims, 6 Drawing Figures

WEFT KNIT FABRIC WITH DEFLECTED INLAID YARN

This invention relates generally to a weft knit fabric which has courses and wales of forwardly facing stitch loops on the face side and courses and wales of rearwardly facing stitch loops on the reverse side and more particularly to such a fabric in which deflected inlaid or filling yarns are incorporated in groups of held stitch loops which are formed in staggered relationship on the face side of the fabric.

It is generally known to incorporate inlaid or filling yarns in various types of rib or double knit fabrics. However, the known types of inlaid yarns extend in substantially a straight coursewise direction with very little deflection or undulation of the yarns as it extends coursewise in the fabric. While various sizes and types of inlaid yarns have been incorporated in knit fabrics, the pattern possibilities are very limited, due to the substantially straight line configuration of the inlaid yarns extending along the courses of the fabric.

With the foregoing in mind, it is an object of the present invention to provide a rib or double knit fabric with inlaid or filling yarns which are deflected with portions of the inlaid yarns extending in diagonal directions between the courses so that a wide range of unique patterns can be formed with the inlaid yarns and on the face side of the fabric.

In accordance with the present invention, the weft knit fabric includes courses and wales of forwardly facing stitch loops on the face side and courses and wales of rearwardly facing stitch loops on the reverse side. The face side of the fabric includes groups of held stitch loops which extend over several courses and in spaced apart groups of adjacent wales. Certain groups of the held stitch loops are staggered walewise relative to the other groups of held stitch loops so that the inlaid yarns which extend behind and are held in position by the held stitch loops are deflected and extend diagonally between the groups of held stitch loops and the inlaid yarns follow undulating paths along the face side of the fabric. The arrangement of held stitch loops can be varied to provide a wide variety of patterns on the face of the fabric. For example, first groups of held stitch loops are provided which extend over several courses and in spaced apart groups of adjacent wales. Second groups of held stitch loops are provided which also extend over several courses and in spaced apart groups of wales and the second groups of held stitch loops are staggered coursewise and positioned between the first groups of held stitch loops. The inlaid yarns extending behind the first groups of held stitch loops also extend behind the held stitch loops of the second groups so that certain of the inlaid yarns are deflected and extend diagonally between the first and second groups of held stitch loops.

In knitting other patterns, it may be desirable to provide third groups of held stitch loops extending over a lesser number of courses than the first and second groups of held stitch loops and being selectively aligned in a coursewise direction with the first and/or second groups of held stitch loops. The inlaid yarns extending behind the first and second groups also extend behind the held stitch loops of the third groups of held stitch loops and are deflected to extend diagonally between the first and second groups of held stitch loops while they are selectively deflected and extend straight behind the third groups of held stitch loops.

The knit fabric of the present invention may be knit on a wide variety of commercially available types of rib or double knit knitting machines having a plurality of yarn feeding and knitting stations positioned around the relatively large diameter needle cylinder. In order to knit the weft fabric of the present invention, the machine must be provided with two sets of needles, such as dial needles for forming the inner or reverse side of the fabric and cylinder needles for forming the outer or face side of the fabric. By varying the needles which knit on the face of the fabric and by selectively knitting yarns of different colors at the knitting stations, it is also possible to form vertically or walewise extending strips in the fabric, as well as other jacquard surface patterns.

Other objects and advantages will appear as the description proceeds when taken in conjunction with the accompanying drawings, in which FIG. 1 is a greatly enlarged view of a fragmentary portion of the face side of the fabric, illustrating the manner in which the inlaid yarns extend behind the groups of held stitch loops and the manner in which the inlaid yarns are deflected to extend diagonally between the groups of held stitch loops;

Figure 1:
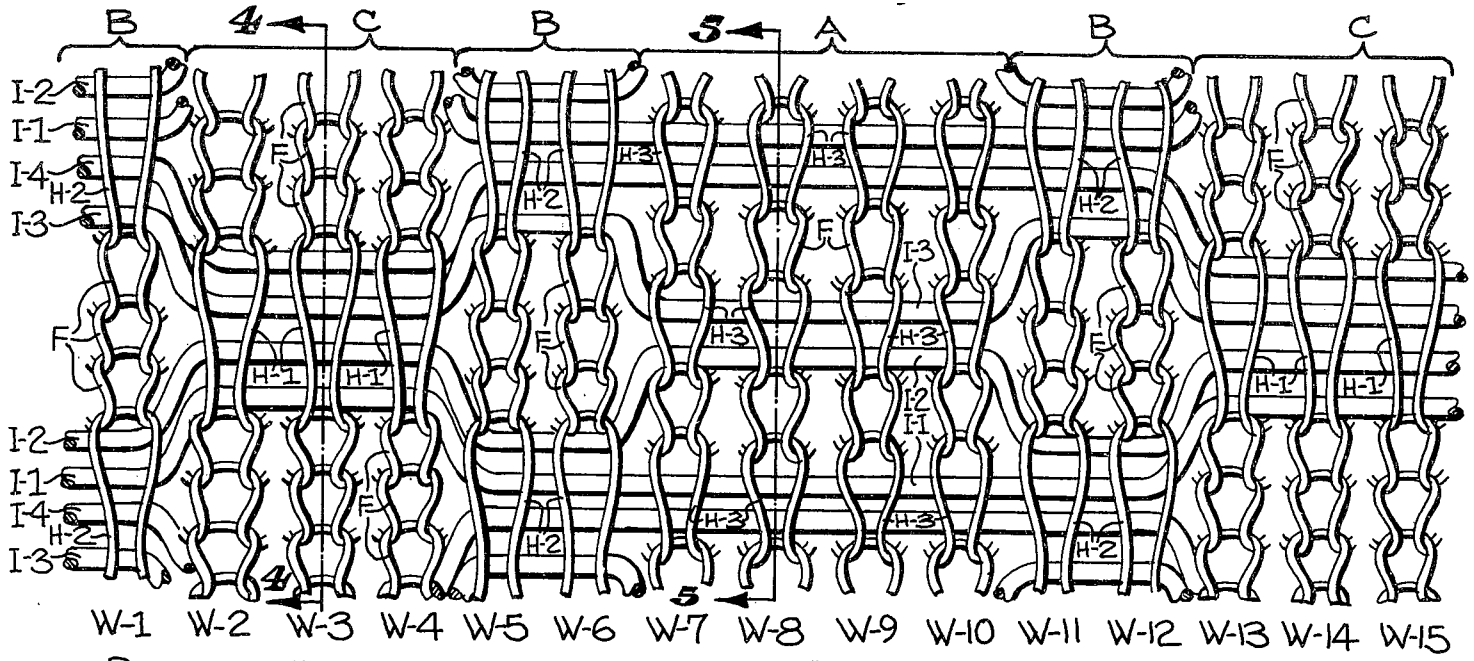
Figure 6:
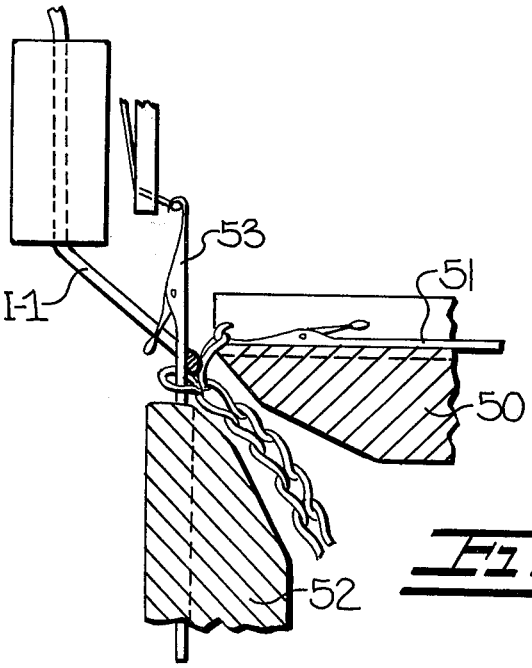
Figure 7:
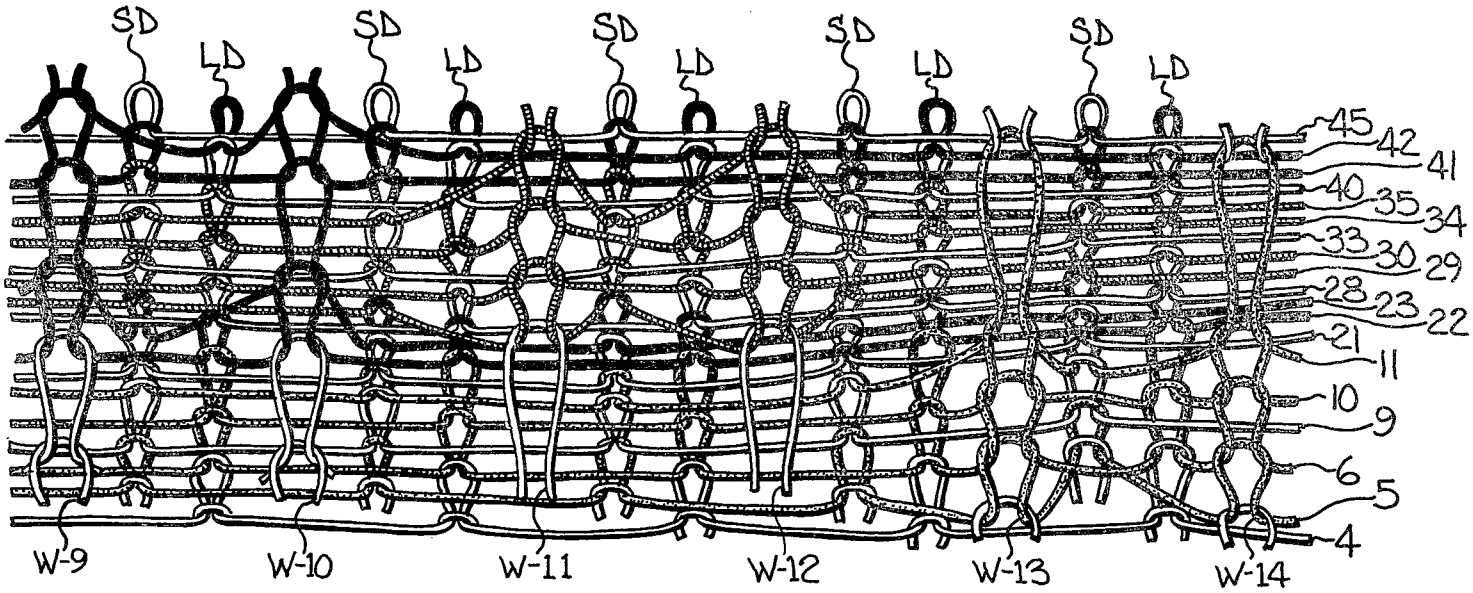

FIG. 6 is a somewhat schematic illustration showing how the inlaid yarn is laid behind or inside of the cylinder needles at certain knitting stations; and FIG. 7 is an elevational view of the lower right-hand portion of FIG. 1 with the forwardly facing stitch loops which are knit on the cylinder needles being spread apart in order to illustrate the manner in which the rearwardly facing wales are knit on the short and long dial needles therebetween and omitting the inlaid yarns.

Figure 4:
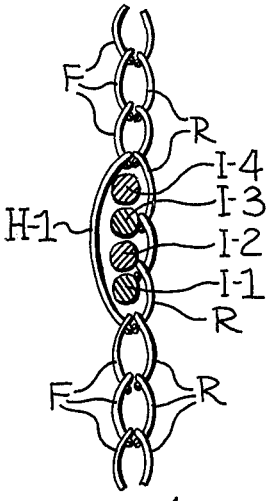
FIG. 4 is a schematic vertical sectional view through the fabric, being taken substantially along the lines 4—4 in FIG. 1.
Figure 5:
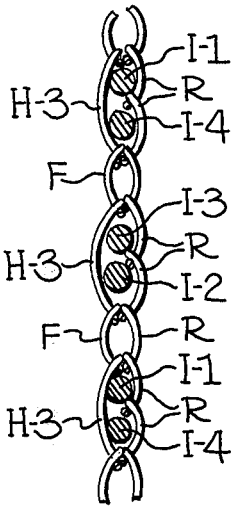
FIG. 5 is a schematic vertical sectional view taken substantially along the line 5—5 in FIG. 1.

As illustrated in FIGS. 1, 4 and 5, the weft knit fabric of the present invention includes courses and wales, indicated at W-1 through W-15, of forwardly facing stitch loops F which are formed over a single course and on the face side of the fabric. Corresponding courses and wales of rearwardly facing single course stitch loops, indicated at R in FIGS. 4 and 5, are formed in the reverse side of the fabric. The face side of the fabric includes groups of held stitch loops which extend over several courses and in spaced apart groups of adjacent wales and the different groups of held stitch loops are staggered coursewise and relative to each other.

In the particular pattern illustrated in FIG. 1, first groups of held stitch loops, indicated at H-1, extend over four courses knit upon cylinder needles and are positioned in spaced apart groups of adjacent wales, indicated by the brackets C in FIG. 1. These first groups of held stitch loops H-1 are positioned in wales W-2, W-3, W-4 and W-13, W-14, W-15. Second groups of held stitch loops, indicated at H-2, also extend over four courses knit upon cylinder needles and are positioned in spaced apart groups of adjacent wales, indicated by the brackets B in FIG. 1. These second groups of held stitch loops H-2 are illustrated in FIG. 1 in wales W-1 and W-5, W-6 and W-11, W-12. It will be noted that the second groups of held stitch loops H-2 are staggered coursewise relative to the first groups of held stitch loops H-1 and the second groups of held stitch loops H-2 are positioned between the first groups of held stitch loops H-1.

If desired, the entire fabric could be knit with the first and second groups of held stitch loops by merely repeating the bracketed groups of adjacent wales B and C. Any desired number of adjacent held stitch loops could be incorporated in the first and second groups of held stitch loops and the stitch loops could be held for a greater or lesser number of courses than that shown in FIG. 1.

A plurality of inlaid yarns, indicated at I-1 through I-4, extend behind the first groups of held stitch loops H-1 and are held in position by the rearwardly facing single course stitch loops R therebehind (FIG. 4). It will also be noted in FIG. 1 that the inlaid yarns extending behind the first groups of held stitch loops H-1 also extend behind the second group of held stitch loops H-2, which groups are staggered above and below the courses in which the first groups of held stitch loops H-1 are formed. Thus, the inlaid yarns I-1 and I-2 are deflected downwardly between wales W-4 and W-5 while the inlaid yarns I-3 and I-4 are deflected upwardly between wales W-4 and W-5 and extend behind the groups of held stitch loops H-2.

In the pattern illustrated in FIG. 1, a third group of held stitch loops, indicated at H-3, is formed on the face side of the fabric and extends over a lesser number of courses than the first and second groups of held stitch loops H-1 and H-2. Each third group of held stitch loops H-3 extends over two courses knit upon cylinder needles and one group of held stitch loops H-3 aligned in a coursewise direction with a first group of held stitch loops H-1 while another group of held stitch loops H-3 is aligned in a coursewise direction with a second group of held stitch loops H-2. The third group of held stitch loops H-3 is formed in adjacent wales W-7 through W-10, indicated by the bracket A in FIG. 1.

Since the third group of held stitch loops H-3 is aligned coursewise with the first or second groups of held stitch loops H-1 and H-2, the inlaid yarns which extend behind the first and second groups of held stitch loops are selectively deflected and extend straight across and behind the third group of stitch loops H-3. Thus, the inlaid yarns I-2 and I-3 are deflected and converge together between wales W-6 and W-7 as they pass behind the third group of held stitch loops H-3. However, I-1 and I-4 are not deflected between wales W-6 and W-7 and the inlaid yarns extend straight across in a coursewise direction and behind the third group of held stitch loops H-3.

It is to be understood that various deniers or sizes and colors of yarns may be used for the inlaid yarns as well as for the body yarns for knitting the stitch loops on both the face and reverse sides of the fabric. It has been found that attractive patterns of vertical stripes may be produced by knitting the body yarns of different colors to form the face stitch loops in the bracketed groups of adjacent wales A B and C. It is to be understood that other types of patterns can also be knit, such as jacquard surface patterns. Also the inlaid yarns are more predominant in the pattern when they are substantially larger than the body yarns. For example, when knitting on an 18 gauge machine, the body yarns are preferably in the range of 70 to 150 denier while the inlaid yarn is about 2.0 cotton count twisted yarn which may be two ends of different colors. Also, it is to be understood that the patterns of held stitch loops can be varied to provide different patterns of greater or lesser amount deflection of the inlaid yarns.

Figure 2:
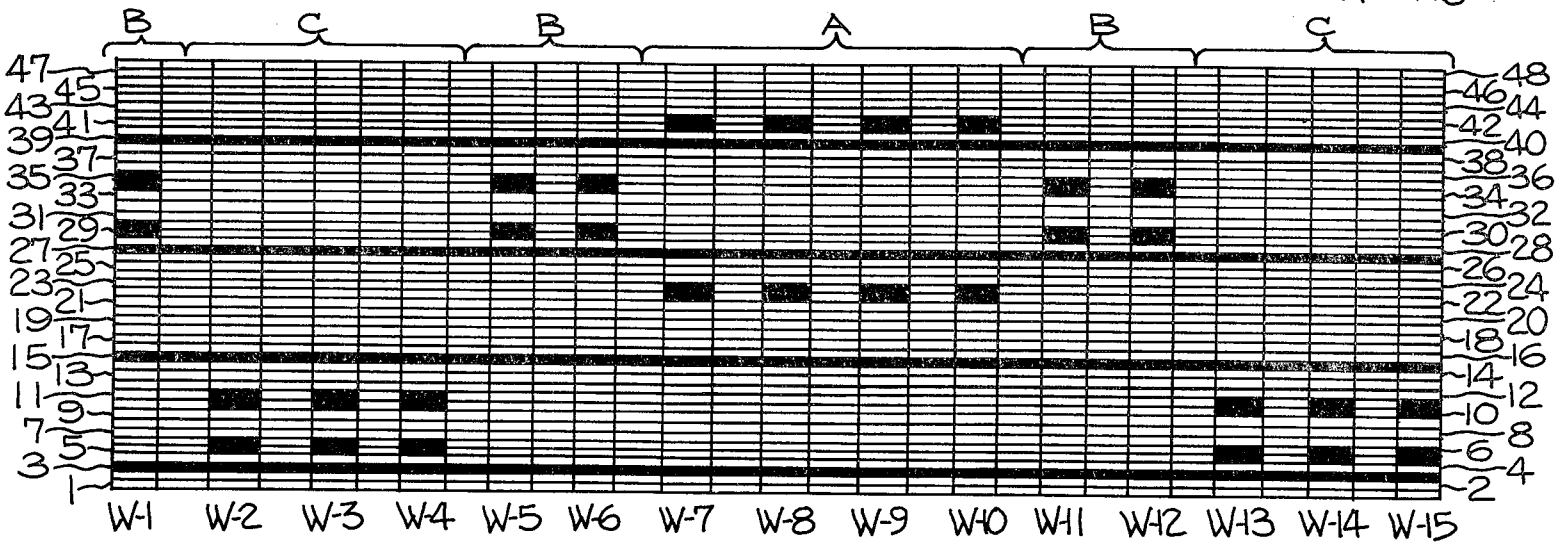
FIG. 2 is a somewhat schematic pattern layout corresponding to the fabric shown in FIG. 1 and illustrating the manner in which the cylinder needles knit and hold the yarn at the knitting stations indicated while the inlaid yarns are laid behind the cylinder needles without knitting at other knitting stations.
Figure 3:
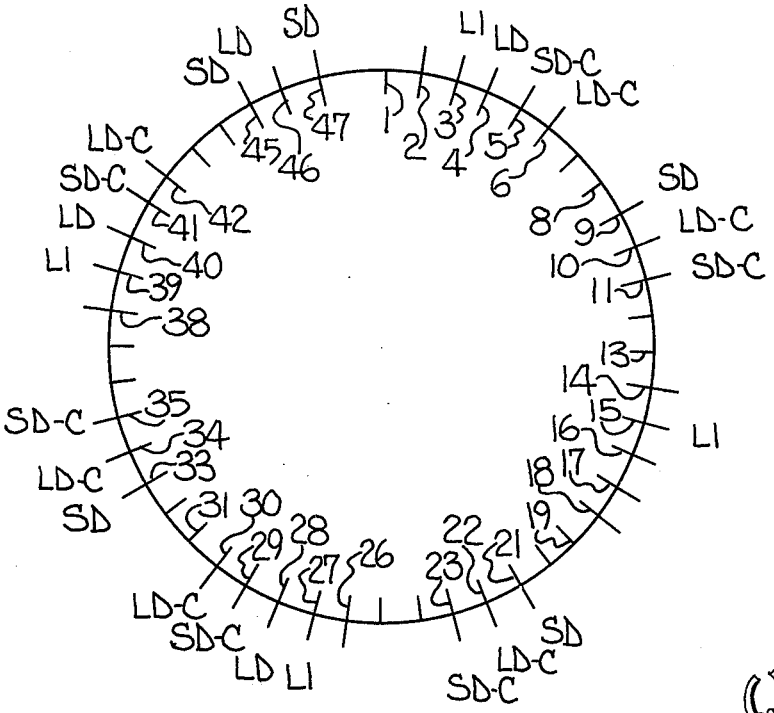
FIG. 3 is a schematic plan view of the needle cylinder of the knitting machine and illustrating the manner in which the needles operate at the various knitting stations.

Referring particularly to FIGS. 2 and 3, the knitting of the fabric will be described on a circular knitting machine having 48 knitting stations and with the inlaid yarns being fed behind the cylinder needles at feeds 3, 15, 27 and 39. While only the cylinder needles which knit are indicated in FIG. 2, the manner in which the dial needles knit at the various knitting stations is schematically illustrated in FIG. 3. The letters SD appear at the stations where the short dial needles knit, the letters LD appear at the stations where the long dial needles knit, and letters SC-C and LD-C appear at those stations where both dial and cylinder needles knit. In FIG. 3 the stations at which the inlaid yarns are fed are indicated by the letters LI.

As shown in FIG. 2, selected needles, the cylinder needles in wales W-2, W-3 and W-4 and wales W-13, W-14 and W-15, successively knit at stations 5, 6, 10 and 11 and the stitch loops are held until the inlaid yarns are laid in at stations 15, 27, 39 and 3, and then these same cylinder needles again pick up and knit the body yarn fed at station 5. This forms the first groups of held stitch loops H-1 with four inlaid yarns held therebehind. On the other hand, the cylinder needles in wales W-1, W-5 and W-6 and wales W-11 and W-12 knit the body yarn at stations 29, 30, 34 and 35 and then hold the stitch loops until the inlaid yarns are laid in at stations 39, 3, 15 and 27, and then these needles again pick up and knit the body yarn at station 29. This forms the second groups of held stitch loops H-2 with four inlaid yarns held therebehind. In knitting the third group of held stitches H-3, the stitch loops which knit at stations 22 and 23 in wales W-7 through W-10 hold the yarn until the inlaid yarns are fed at stations 27 and 39, and then these cylinder needles again knit at station 41 to hold two inlaid yarns therebehind.

The schematic illustration in FIG. 6 shows the dial 50 of the knitting machine which contains radially movable dial latch needles 51 which alternately include long and short operating butts, not shown, for knitting the single course stich loops R on the reverse side of the Fabric (FIGS. 4 and 5). The needle cylinder 52 contains vertically movable latch needles 53 which are raised to pick-up and knit the yarn by suitable pattern means, not shown, and which are at times operated with the dial needles to permit the inlaid yarn, indicated at I-1 in FIG. 6, to be incorporated between the face and reverse stitches of the fabric. As shown in FIG. 6, the inlaid yarn I-1 is laid in behind the cylinder needles 53 and is held in position between the forwardly facing held stitch loops formed on the cylinder needles and the rearwardly facing stitch loops R formed on the dial needles. The manner in which the inlaid yarns are held between the held stitch loops on the face side of the fabric and the single course stitch loops on the reverse side is illustrated in FIGS. 4 and 5.

The fabric illustrated in FIG. 7 encompasses wales W-9 through W-14 of FIG. 1 and the yarns which are knit at stations 5, 6, 10 and 11 (FIG. 3) have been stippled. The yarns which knit at stations 22, 23, 41 and 42 are black while the yarns which knit at stations 29, 30, 34 and 35 are striped. As illustrated in FIG. 7, the yarn which knits at station 5 thus forms rearwardly facing stitch loops in every wale knit by the short dial needles and forms forwardly facing stitch loops in the wales knit on selected cylinder needles, those needles which knit wales W-13 and W-14. The yarn which knits at station 6 forms rearwardly facing stitch loops in every wale knit by the long dial needles and forms forwardly facing stitch loops in the wale knit on selected cylinder needles, those needles which knit wales W-13 and W-14. The yarn which is knit at station 9 forms only rearwardly facing stitch loops in every wale knit by the short dial needles. The yarn which knits at station 10 forms rearwardly facing stitch loops in every wale knit by the long dial needles and forms forwardly facing stitch loops in the wales knit by the cylinder needles which knit the wales W-13 and W-14. The yarn knit at station 11 forms rearwardly facing stitch loops in every wale knit by the short dial needles and forms forwardly facing stitch loops in the wales knit by the cylinder needles which knit the wales W-13 and W-14 and these stitch loops are held while the other stations knit and until the yarn is again knit at station 5. The yarn at station 21 knits on only the short dial needles to form rearwardly facing stitch loops thereon and the manner in which the yarns knit at the remaining active stations corresponds to the layout shown in FIG. 3.

While the fabric illustrated in the present application is of the double knit type, it is to be understood that the present weft knit fabric could be formed on any type of circular knitting machine having two sets of needles, one of which is adapted to knit the rearwardly facing stitch loops while the other set of needles knits the forwardly facing stitch loops. It is to be understood that the held groups of stitch loops in the present fabric can be varied, as to position, in staggered relationship so that the amount and type of deflection of the inlaid yarns can be varied to provide a wide variety of unique surface patterns on the face side of the fabric.

In the drawings and specifications there has been set forth a preferred embodiment of the invention, and although specific terms are employed, they are used in a generic and descriptive sense only and not for purposes of limitation.

That which is claimed is:

1. A weft knit fabric having courses and wales of forwardly facing stitch loops on the face side thereof and courses and wales of rearwardly facing stitch loops on the reverse side thereof, the face side of said fabric including a. first groups of held stitch loops extending over several courses and in spaced apart groups of adjacent wales, b. second groups of held stitch loops extending over several courses and in spaced apart groups of adjacent wales, said second groups of held stitches being staggered coursewise relative to said first groups of held stitches, said second groups of held stitches being positioned between said first groups of held stitches, and c. a plurality of inlaid yarns extending behind said first groups of held stitch loops and being held in position by said rearwardly facing stitch loops therebehind, certain of said inlaid yarns extending behind said first groups of held stitch loops also extending behind said held stitch loops of said second groups of held stitch loops so that said certain inlaid yarns are deflected and extend diagonally between said first and second groups of held stitch loops.

2. In a knit fabric according to claim 1 wherein said inlaid yarns (c) are substantially larger than the yarns forming said forwardly and rearwardly facing stitch loops of the fabric.

3. In a knit fabric according to claim 1 including d. third groups of held stitch loops extending over a lesser number of courses than said first and second groups of held stitch loops, said third groups of held stitch loops being selectively positioned between said first and second groups of held stitch loops, said third groups of held stitch loops being selectively aligned in a coursewise direction with said first and second groups of held stitch loops, and said certain of said inlaid yarns extending behind said first and second groups of held stitch loops also extending behind said held stitch loops of said third groups of held stitch loops.

4. In a knit fabric according to claim 1 wherein said plurality of inlaid yarns extending behind said first and second groups of held stitch loops comprises four yarns.

5. In a knit fabric according to claim 3 wherein said certain of said inlaid yarns extending behind said held stitch loops of said third groups of held stitch loops comprises two yarns.

6. In a knit fabric according to claim 5 wherein said two inlaid yarns extending behind said third groups of held stitch loops which are aligned with said first groups of held stitch loops are deflected at opposite sides of said third groups of held stitch loops.

7. In a knit fabric according to claim 5 wherein said two inlaid yarns extending behind said third groups of held stitch loops which are aligned with said second groups of held stitch loops extend straight across and behind said second groups of held stitch loops.

* * * * *